US006123308A

United States Patent [19]

Faisst

[11] Patent Number: 6,123,308

[45] Date of Patent: Sep. 26, 2000

[54] SHOWER HOLDER

[75] Inventor: Magdalena Faisst, Schiltach, Germany

[73] Assignee: Hans Grohe GmbH & Co., KG, Schiltach, Germany

[21] Appl. No.: 08/611,561

[22] Filed: Mar. 6, 1996

[30] Foreign Application Priority Data

Mar. 8, 1995 [DE] Germany ..... 195 08 251

[51] Int. Cl.[7] ..... F16M 13/00

[52] U.S. Cl. ..... 248/316.1; 4/605

[58] Field of Search ..... 4/615, 605, 597; 248/316.5, 316.1, 316.4

[56] References Cited

U.S. PATENT DOCUMENTS

| | | | |
|---|---|---|---|
| 3,865,310 | 2/1975 | Elkins et al. | 248/316.7 |
| 5,408,709 | 4/1995 | Lockwood | 4/605 |
| 5,481,765 | 1/1996 | Wang | 4/615 |
| 5,632,049 | 5/1997 | Chen | 4/615 |

FOREIGN PATENT DOCUMENTS

| | | |
|---|---|---|
| 1252142 | 12/1960 | France . |
| 2459644 | 1/1981 | France . |
| 8027713 | 2/1981 | Germany . |
| 3144893 | 5/1983 | Germany . |
| 3506124 | 8/1986 | Germany . |
| 3507291 | 9/1986 | Germany . |
| 9110622 | 11/1991 | Germany . |
| 4040688 | 7/1992 | Germany . |
| 4106878 | 9/1992 | Germany . |

*Primary Examiner*—Ramon O. Ramirez
*Attorney, Agent, or Firm*—Duane, Morris & Heckscher, LLP

[57] ABSTRACT

A shower holder for the removable attachment of a hand shower contains a sleeve element with a conical inner bore, the sleeve element laterally having a through longitudinal slot. This permits the lateral insertion of the shower tube, whilst the hand shower is slid in axially and fixed by clamping action.

To improve the adhesion or reduce the insertion forces, the inner cone has an elastomeric material lining. The elastomeric material can be injected through the wall of the sleeve element, so as to form on the outside a ring element, which can be used for soundproofing purposes during locking.

11 Claims, 2 Drawing Sheets

SHOWER HOLDER

BACKGROUND OF THE INVENTION

The invention is based on a shower holder for the removable attachment of a hand shower.

Such shower holders are used for securing a hand shower during or after use in such a way that the shower can be used. The shower holder can either be fixed directly to the wall or can be secured with a slide to a wall bar, so that it can still be adjusted.

PRIOR ART

For securing the hand shower conventional shower holders have a slotted sleeve element and an inner cone. The inner cone cooperates with a conical element of the hand shower, normally a cone nut. The slot necessary for the passage of the shower tube, gives a certain elasticity to the cone sleeve, so that the hand shower can be fixed there by clamping.

The sleeve element in which the hand shower is secured can be pivoted about an axis perpendicular to the longitudinal axis of the cone in such a way as to enable the hand shower to be so adjusted that the jets pass out in a certain direction. An example for such a pivoting is given in German patent 35 06 124.

SUMMARY OF THE INVENTION

The problem of the invention is to further improve the handling of a shower holder for the user.

As a result of the elastomer layer proposed by the invention the movement can have a more pleasant feel for the user, so that optionally reduced forces are needed or a reduced holding force is required.

For example, the conical surface of the sleeve element can have an elastomer layer. As a result of the flat lining of the conical surface, preferably over the entire conical surface, an insertion of the hand shower with a reduced force is possible, because the holding force of the shower holder is increased. This gives the user a more pleasant feel, because the insertion appears to be somewhat decelerated.

It is also possible for the sleeve element to have on its outside an elastomer layer, on which engages flat part of the attachment during the pivoting of the sleeve element. This leads to a similar effect to that obtained on lining the conical surface for the insertion of the hand shower.

According to the invention, the elastomer layer has a ring shape on the outside of the sleeve element and the attachment engages radially with respect to the pivoting axis on the elastomer layer.

According to the invention, the shower holder can have a locking device for the locking pivoting of the sleeve element, the locking device containing a locking element, which is radially deformed with respect to the pivoting axis and engages on the elastomer layer at least during deformation. The elastomer layer can help to permit a weaker construction of the locking element or to limit its deformation in that towards the end of the deformation movement part of the deformation is taken up by the flat elastomer layer and is consequently distributed.

As a pivoting of the sleeve element takes place on two opposite outsides, preferably at both said points the elastomer layer is located on the outside.

According to a further development of the invention, the elastomer layer is connected on the inside of the sleeve element to that on its outside. This connection can take place through the sleeve element and preferably the elastomer layer is injected through openings in the sleeve element. The elastomer layer can be produced in a cohesive or one-piece manner.

According to a further development, the inner conical surface of the sleeve element has depressions, holes, etc. which optionally pass through to the outside of the sleeve element and into which the elastomer layer is injected.

Further features, details and advantages can be gathered from the claims, whose wording is by reference made into part of the content of the description, the following description of a preferred embodiment of the invention and the attached drawings, wherein show:

DETAILED DESCRIPTION OF THE PREFERRED EMBODIMENTS

Figure 1:
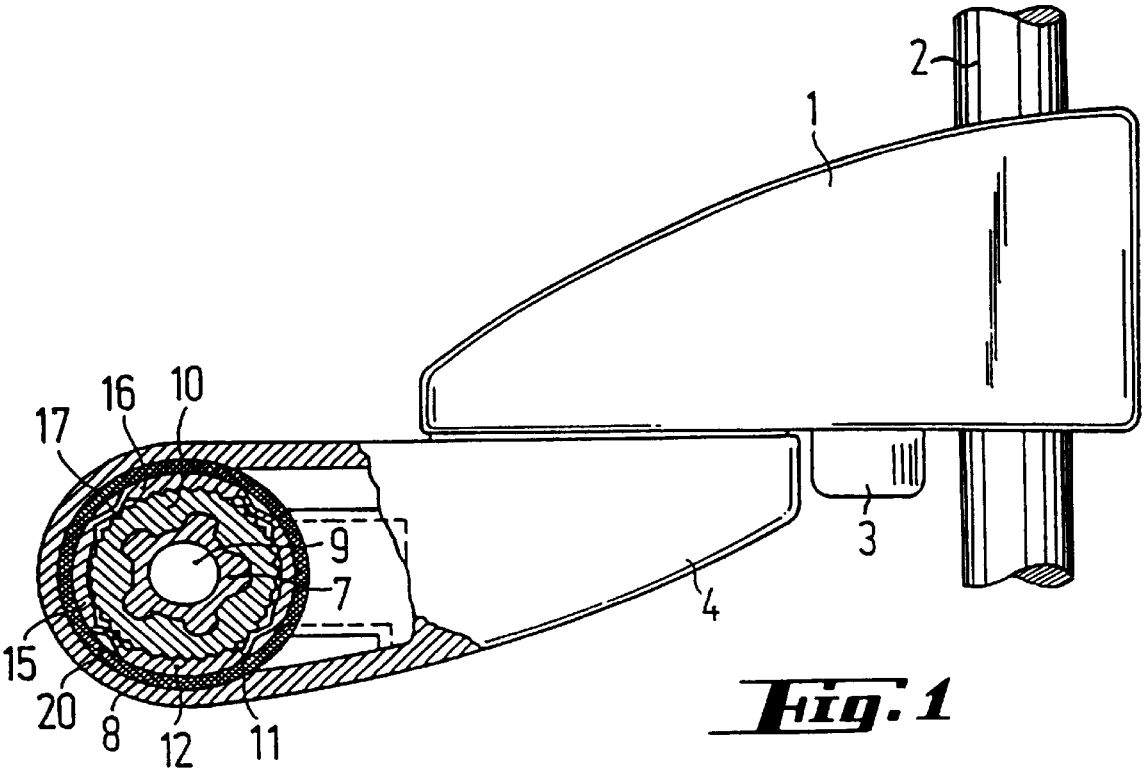
FIG. 1 A part sectional side view of a shower holder for removable attachment of a hand shower on a wall bar.
Figure 2:
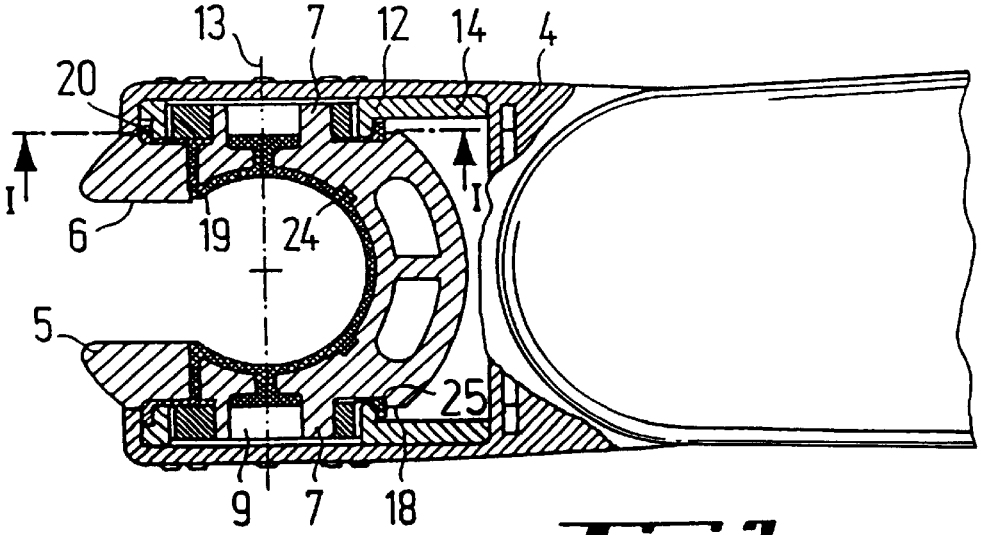
FIG. 2 A partial cross-section through the arrangement of FIG. 1 in a horizontal plane.

The shower holder shown in part sectional form in FIG. 1 contains a slide 1, which is displaceably guided on a vertically directed wall bar 2. The wall bar 2 is e.g. screwed with holders to a bathroom wall. For locking the slide 1 in a particular position a braking element is provided, which can be released with the aid of an actuating element 3 in the form of a push button. On the slide is mounted the actual shower holder 4, which is rotatable about a vertical axis, which is parallel to the wall bar 2. As can be seen in FIG. 2, in the shower holder 4 is retained a sleeve element 5 and namely in the represented embodiment in a manner allowing a pivoting of the sleeve element 5 about an axis perpendicular to the paper plane of FIG. 1. The sleeve element contains in its interior a cross-sectionally circular inner opening, whose diameter decreases from top to bottom, so that an inner cone shape is formed. Access to said inner cone shape takes place through a lateral slot 6, whose width is less than the inner cone diameter, but more than the shower tube diameter.

On two facing lateral edges, the sleeve element has in each case a stub-like lug 7, which in a manner to be described hereinafter forms a shaft lug mounted in the side parts of the shower holder 4.

In the vicinity of its end remote from the wall bar 2, the shower holder has an approximately U-shaped slot in which is located the sleeve element 5. In the two legs of the U the shower holder 4 has a circular depression, which is bounded by a skirt 8 over a large part of its circumference.

The stub-like lug 7, which is shaped in one-piece manner on the two opposite outsides of the sleeve element 5, is provided in its interior with a circular depression 9, whilst its outside is shaped like a five-element star. On said stub-like lug 7 is engaged a tooth lock washer 10, which is e.g. made from a different material. On its outside the tooth lock washer 10 has a tooth system 11. As a result of the star shape of the lug 7, the tooth lock washer 10 is connected in non-rotary manner to the sleeve element 5.

Within the skirt 8 in the shower holder 4 is arranged in non-rotary manner a locking element 12, whose non-rotary connection is secured by a projection 14 directed radially outwards with respect to the pivoting axis 13. This locking element 12 is shaped like a ring with four arcuate elements 15, 16, which are interconnected by weak points 17. In each case two facing arcuate elements 16 are provided on their radial inside with an inner tooth system corresponding to the tooth system 11, whilst the two other also facing arcuate elements 15 have a smooth construction on their radial inside. All the arcuate elements 15, 16 have a smooth outer surface, which engages on a cylindrical surface.

Outside the stub-like lugs 7 is formed a torus 25, which is radially outwardly bounded by a short skirt 18.

Prior to the engagement of the tooth lock washers 10, the inner conical surface of the sleeve element 5, the torus 25 radially outside the stub-like lugs 7 and the bottom of the depressions 9 are connected to an elastomer material lining 19. This elastomer material also forms on the outer edge of the torus 25 a short cylindrical ring element 20, whose radial outside engages on the radial inside of the skirt 8 of the shower holder 4.

This lining is produced in that, starting from the depressions 9, the elastomer material is injected inwards into the stub-like, star-shaped lugs 7 through openings in the sleeve element 5 and towards the inside, from where it passes through other through openings into the annular space radially outside the lugs 7. Thus, there is a complete covering of the inner conical surface of the sleeve element 5, together with the outsides. The ring element 20 is located, as can be seen in FIG. 1, between the skirts 8 and the outside of the locking element 12.

Figure 3:
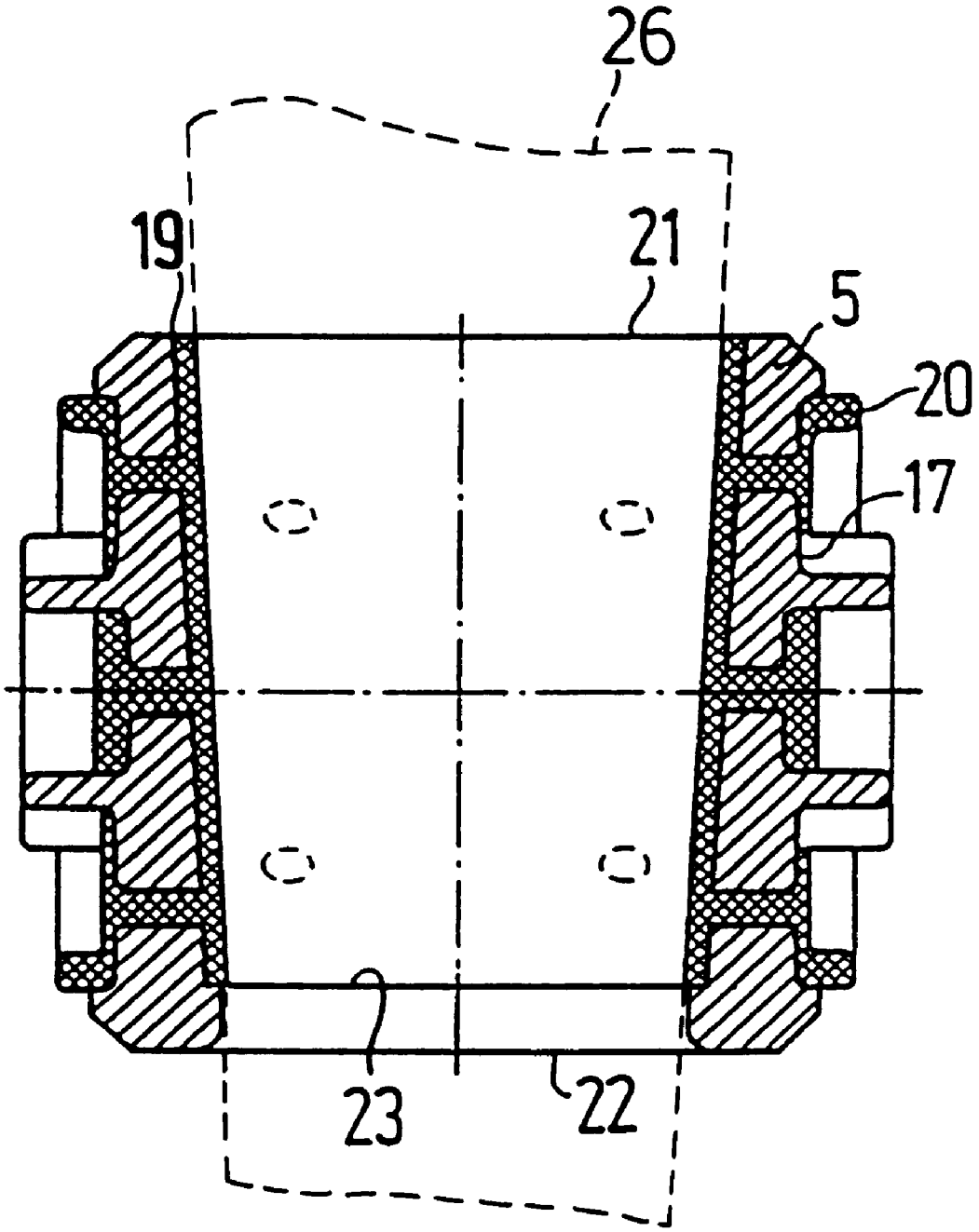
FIG. 3 A vertical cross-section through the shower holder sleeve element according to the invention.

The arrangement of the lining 19 of the sleeve element 5 is shown in greater detail in FIG. 3. As stated, the lining 19 covers the inner conical surface and is connected via passages to the ring element 20. The bottom of the torus 17 is also covered.

On pivoting the sleeve element 5 with respect to the shower holder 4, as a result of the rotation of the tooth lock washer 10 with respect to the fixed locking element 12 the arcuate elements 16 provided with the inner tooth system are forced outwards. This leads to a deformation of the weak points 17 between the individual arcuate elements 15, 16. Following a short radial, outward displacement the arcuate elements 16 engage on the inside of the ring element 20, so that their further outward movement is limited by the somewhat deformable elastomeric material of the ring element 20. Therefore the locking elements 16 or the weak points 17 can be made in weaker form between the arcuate elements, because a large part of the forces is absorbed by the elastomeric material. As a result of the damping characteristics of the elastomeric material there is also a soundproofing or a somewhat less hard locking, which gives a more pleasant feel for the user. The pivoting of the sleeve element takes place by the user gripping the inserted hand shower 26.

On axially inserting the hand shower 26 into the sleeve element, the user only need slide it in with a reduced force, because the elastomeric material of the lining has an increased static friction.

As can be seen from FIG. 3, the elastomer lining extends from the upper edge 21 of the sleeve element 5 to just before its lower edge 22. In the vicinity of the lower edge 22 is formed an inner shoulder 23 on which engages the lower edge of the lining 19. It projects somewhat radially inwards, so that the shower grip is not prevented by the stronger material of the sleeve element 5 from somewhat compressing the elastomeric material of the lining.

For securing the fixing of the elastomeric material individual depressions 24 can be provided and into which the material is injected. Further measures can also be taken for bringing about a better adhesion of the elastomeric material.

What is claimed is:

1. Shower holder with removable attachment of a hand shower having a conical element, the shower holder comprising: a sleeve element formed with a slot, a conical shaped inner surface and having a sleeve element axis, the conical shaped inner surface being axially couplable with the conical element, said sleeve element securing the hand shower by clamping the conical element, said sleeve element being pivotally held in the shower holder about a pivot axis at right angles to the sleeve element axis wherein at least one elastomeric material layer is coupled to at least one of the conical element and shower holder, and wherein the sleeve element has two facing lateral edges and the shower holder has two side parts, the two facing lateral edges and the two side parts being pivotally coupled and a second elastomer layer being disposed between said two facing lateral edges and two side parts.

2. Shower holder according to claim 1, wherein a first elastomer layer is adhered to the conical shaped inner surface of the sleeve element.

3. Shower holder according to claim 1, wherein the two facing lateral edges of the sleeve element are formed with at least one depression operable to receive injected elastomer material which forms the second elastomer layer.

4. Shower holder according to claim 1, wherein said second elastomer layer is ring shaped adhered to the shower holder.

5. Shower holder according to claim 1 further comprising a locking device operable to prevent the sleeve element from pivoting, the locking device having a locking element, which is deformed radially with respect to the pivoting axis and at least during the deformation engages on the elastomer layer.

6. Shower holder according to claim 1, further comprising a first elastomer layer coupled to the conical shaped inner surface of the sleeve element.

7. Shower holder according to claim 6, wherein the sleeve element is formed with at least one opening operable to receive injected elastomer material which forms at least one of the first and second elastomer layers.

8. Shower holder according to claim 6, wherein at least one of the conical shaped inner surface and the two facing lateral edges are formed with at least one depression operable to receive injected elastomer material which forms at least one of the first and second elastomer layers.

9. Shower holder according to claim 8, wherein the at least one depression is operable to connect the inner conical surface and the two facing lateral edges of the sleeve element.

10. Shower holder according to claim 1, further comprising two separately formed elastomer layers.

11. Shower holder with removable attachment of a hand shower having a conical element, the shower holder comprising:

a sleeve element formed with a slot, a conical inside shape and having an axis, the sleeve element being operable to receive the conical element thereby mechanically securing the hand shower by clamping the conical element;

an elastomeric material coupled to the sleeve element, wherein the shower holder has two side parts and the sleeve element has two facing lateral edges, the two side parts and the two lateral edges being pivotally coupled and a second elastomer layer being disposed between said two side parts and two facing lateral edges, the side parts being formed with at least one depression operable to receive injected elastomer material for forming a second elastomer layer.

* * * * *